US007424804B2

(12) United States Patent
Bellucci et al.

(10) Patent No.: US 7,424,804 B2
(45) Date of Patent: Sep. 16, 2008

(54) PREMIX BURNER

(75) Inventors: Valter Bellucci, Fislisbach (CH); Francois Meili, Nyon (CH); Christian Oliver Paschereit, Berlin (DE); Bruno Schuermans, Basel (CH)

(73) Assignee: ALSTOM Technology Ltd, Baden (CH)

( * ) Notice: Subject to any disclaimer, the term of this patent is extended or adjusted under 35 U.S.C. 154(b) by 208 days.

(21) Appl. No.: 11/214,919

(22) Filed: Aug. 31, 2005
(Under 37 CFR 1.47)

(65) Prior Publication Data

US 2006/0101825 A1 May 18, 2006

Related U.S. Application Data

(63) Continuation of application No. PCT/EP2004/050243, filed on Mar. 3, 2004.

(30) Foreign Application Priority Data

Mar. 7, 2003 (CH) ..... 2003 0363/03

(51) Int. Cl.
*F02C 3/00* (2006.01)
*F23R 3/04* (2006.01)
*F23R 3/14* (2006.01)

(52) U.S. Cl. ..... 60/725; 60/737; 431/115

(58) Field of Classification Search ..... 60/725, 60/737, 748; 431/115
See application file for complete search history.

(56) References Cited

U.S. PATENT DOCUMENTS

| | | | | |
|---|---|---|---|---|
| 3,439,774 | A | 4/1969 | Callaway et al. | 181/42 |
| 3,640,357 | A | 2/1972 | Kitching et al. | 181/33 G |
| 3,831,710 | A | 8/1974 | Wirt | 181/33 G |
| 4,141,213 | A * | 2/1979 | Ross | 60/737 |
| 4,781,030 | A | 11/1988 | Hellat et al. | 60/743 |
| 4,932,861 | A | 6/1990 | Keller et al. | 431/8 |
| 5,353,958 | A | 10/1994 | Hawkins | 222/54 |
| 5,431,018 | A | 7/1995 | Keller | 60/724 |
| 5,685,157 | A | 11/1997 | Pandalai et al. | 60/725 |
| 5,735,687 | A | 4/1998 | Knöpfel et al. | 431/354 |
| 5,738,509 | A | 4/1998 | Marling et al. | 431/352 |
| 5,782,082 | A | 7/1998 | Hogeboom et al. | 60/226.1 |
| 6,106,276 | A * | 8/2000 | Sams et al. | 431/114 |
| 6,164,058 | A | 12/2000 | Dobbeling et al. | 60/39.36 |
| 6,438,961 | B2 * | 8/2002 | Tuthill et al. | 60/737 |
| 6,632,084 | B2 | 10/2003 | Berenbrink | 431/284 |
| 6,981,358 | B2 * | 1/2006 | Bellucci et al. | 60/725 |
| 2001/0017232 | A1 | 8/2001 | Hogeboom et al. | 181/286 |

(Continued)

FOREIGN PATENT DOCUMENTS

| | | |
|---|---|---|
| EP | 0 321 809 B1 | 6/1989 |

(Continued)

*Primary Examiner*—Ted Kim
(74) *Attorney, Agent, or Firm*—Steptoe & Johnson LLP

(57) ABSTRACT

A premix burner has a swirl generator and two perforated through flow elements are arranged at a defined distance from one another in the inflow region for the combustion air. The through flow elements are preferably arranged in such a way that substantially the entire combustion airstream has to flow through the through flow elements. The degree of perforation of the through flow elements and the distance between these elements are preferably adapted to one another in such a way that a reflection free condition for combustion pulsation frequencies which may be expected is present at the exit from the burner into the combustion chamber.

14 Claims, 3 Drawing Sheets

U.S. PATENT DOCUMENTS

2003/0110774 A1 * 6/2003 Saitoh ..... 60/737

FOREIGN PATENT DOCUMENTS

| | | | |
|---|---|---|---|
| EP | 0 742 411 | A2 | 11/1996 |
| EP | 0 780 629 | B1 | 6/1997 |
| EP | 0 899 506 | A2 | 3/1999 |
| EP | 0 945 677 | A2 | 9/1999 |
| EP | 0 971 172 | B1 | 1/2000 |
| EP | 1 219 900 | A2 | 7/2002 |
| EP | 1 221 574 | A2 | 7/2002 |
| GB | 2390150 | A * | 12/2003 |
| WO | WO 93/17279 | | 9/1993 |
| WO | WO 00/12936 | | 3/2000 |

* cited by examiner

PREMIX BURNER

CROSS-REFERENCE TO RELATED APPLICATIONS

This application is a continuation of the U.S. National Stage designation of co-pending International Patent Application PCT/EP2004/050243 filed Mar. 3, 2004, which claims priority to Swiss patent application no. 2003 0363/03 filed in Switzerland on Mar. 7, 2003, and the entire contents of these applications are expressly incorporated herein by reference thereto.

FIELD OF THE INVENTION

The present invention relates to a premix burner.

BACKGROUND OF THE INVENTION

Modern gas turbine engineering predominantly uses what are known as lean-burn premix burners. A very wide range of designs of lean-burn premix burners are known, for example from U.S. Pat. No. 4,781,030, EP 321 809, EP 780 629, WO 93/17279, EP 945 677 or WO 00/12936. These burners substantially work on the principle of introducing fuel into an airstream which has been greatly swirled up and in which this fuel forms a homogenous mixture with the combustion air. The ignition and flame stabilization are effected by the swirling flow breaking open at the burner exit, i.e. at the opening of the burner to the combustion chamber. It is preferable for these burners to be operated at a substoichiometric fuel/air ratio, typically with air/fuel ratios around 2. This prevents the formation of stoichiometric zones with hot spots in the flame, at which high levels of nitrogen oxides are produced, and the good premixing usually also results in a good level of burnup. These premix burners are often designed to operate in the region of the lean extinction limit, which restricts the operating range. Therefore, what are known are pilot stages or pilot burners, via which additional fuel is introduced into the combustion chamber in certain operating ranges, are used for operation with a fuel quantity which is below that required for stable premix operation.

Under certain unfavorable circumstances, all known premix burners may on occasion have a tendency to form thermoacoustic oscillations in the combustion chamber. These undesirable oscillations can be reduced firstly by suitable control of the fuel supply and of the fuel distribution and secondly by damping measures within the combustion chamber. For example, U.S. Pat. No. 5,685,157 has disclosed an acoustic damper for a combustion chamber which is formed by a plurality of resonating tubes which are in communication with the combustion chamber via a perforated plate. These resonating tubes serve as Helmholtz resonators which damp individual thermoacoustic oscillations depending on the size of the resonating volume. U.S. Pat. No. 5,431,018 also shows the use of Helmholtz resonators at a combustion chamber. In this document, an annular air duct for feeding cooling and combustion air into the combustion chamber, which is in communication with a resonator volume, is formed around the feedline for fuel leading to a combustion chamber. U.S. Pat. No. 6,164,058 has disclosed an arrangement for damping acoustic oscillations in a combustion chamber, in which the length of cooling passages formed at the combustion chamber wall is adapted in such a manner that these cooling passages have a minimal acoustic impedance at the location where the cooling air enters the burner. Some of this cooling air is then mixed with the fuel in the burner and at the burner exit is passed into the combustion chamber for combustion. Although Helmholtz resonators can achieve very high levels of damping, they can only do so in a very narrow frequency range, to which the resonance volume is tuned. They are particularly suitable for the damping of individual oscillations in the low-frequency range, in which the frequency separation between the undesirable oscillations is relatively great.

In modern gas turbine installations which operate with premix burners, however, higher-frequency oscillations which are close together may also occur in a wide frequency range as a result of what are known as combustion chamber pulsations, and these oscillations jeopardize the quality of the combustion process and also the structural integrity of the installations. Helmholtz resonators are relatively unsuitable for damping wide-band oscillations of this nature.

SUMMARY OF THE INVENTION

A premix burner is intended to be specified in such a manner that the burner simultaneously allows damping of acoustic combustion chamber pulsations during operation.

Therefore, a premix burner which is suitable in particular for a gas turbine installation comprises a swirl generator for a combustion airstream flowing to the burner. A first perforated through-flow element is arranged in the inflow region for the combustion air and a second through-flow element is arranged at a well-defined distance upstream of the first through-flow element. Preferably, the through-flow elements are arranged in such a manner that substantially the entire combustion airstream has to flow through the through-flow elements. In a preferred embodiment of the invention, the burner is designed in such a manner that the first through-flow element is a hollow cylinder and the second through-flow element is a hollow cylinder surrounding the first through-flow element. It is preferable for these two hollow cylinders to be arranged co-axially. In a refinement of this embodiment, the swirl generator is arranged within the first hollow cylinder. The end sides of the burner are then highly advantageously designed and closed in such a manner that no combustion air or only an insignificant mass flow can flow between the swirl generator and the through-flow elements.

In one embodiment of the invention, the swirl generator comprises a plurality of, in particular two or four, part-bodies, which in a preferred embodiment are substantially in the form of segments of a truncated cone, and between which lateral entry slots for the supply of the combustion air are formed. In a preferred embodiment, the longitudinal axes of the individual part-bodies are laterally offset with respect to one another.

On account of the configuration with two through-flow elements through which medium can flow in series, it is possible to avoid the undesirable change in the pressure drop for a given mass flow by changing the degree of perforation for adjusting the acoustic damping. In other words, the degree of perforation of one of the through-flow elements can be varied and adapted to particular requirements without altering the overall pressure drop or the pressure loss coefficient. The second through-flow element, which is arranged upstream, can be designed with a suitable degree of perforation for adapting to the desired acoustic damping, in order to obtain maximum acoustic damping in a defined frequency range. The pressure drop is set by means of the first through-flow element.

By suitably designing the through-flow elements as a function of the combustion chamber pulsations which occur during operation of a combustion chamber with the premix burner and are to be avoided, it is possible to damp these acoustic oscillations. In the plane of the burner exit, the perforated through-flow elements act as an acoustically damping wall, the reflection-free condition for the acoustic impedance being satisfied in the plane of the burner exit taking account of the combustion air velocity which occurs in operation.

It is preferable for the through-flow elements to be adapted to one another by changing the degree of perforation, the thickness and also the distance between them, in such a manner that, at least when the burner is operating in the intended way, the first through-flow element, which is arranged downstream, at least approximately completely reflects the acoustic oscillations; the second through-flow element is designed in such a way as to effect maximum damping of the acoustic oscillations.

The reflection-free condition for the acoustic impedance can be satisfied in particular by the distance between the first through-flow element and the second through-flow element, the degree of perforation of the through-flow elements and the extent of the through-flow elements in the direction of through-flow being adapted to one another in such a manner that the complex acoustic impedance for characteristic pulsation frequencies of the burner at least approximately corresponds to the product of the density of the combustion air and the acoustic velocity in the combustion air.

To satisfy the reflection-free condition for the complex acoustic impedance, it is preferable for the distance between the first through-flow element and the second through-flow element, the degree of perforation of the first through-flow element and the extent of the first through-flow element in the direction of through-flow to be adapted to one another in such a manner that the imaginary component of the complex acoustic impedance substantially becomes zero.

Furthermore, the first downstream through-flow element is advantageously designed in such a manner that the ratio of the degree of perforation to the pressure loss coefficient of the first through-flow element at least approximately corresponds to the Mach number of the combustion air flowing through it.

In this context, the degree of perforation is defined as the ratio of the open cross section of flow to the total cross section of a perforated element.

The design of a premix burner in accordance with the invention causes combustion chamber pressure fluctuations to be at least partially absorbed and therefore damped. The perforated through-flow elements in this respect act as an acoustic damping element. The supply of the combustion air for the swirl generator via the perforated through-flow elements maintains a continuous through-flow which, given a sufficient velocity, considerably increases the damping action compared to damping elements which do not have a through-flow of this nature.

When designing the perforated through-flow elements, it is preferable for the reflection-free condition for the acoustic impedance $Z=R+iX=\rho*c$ to be at least approximately satisfied in the plane of the burner exit. The real component R of the complex acoustic impedance Z is in this context referred to as the resistance, and the imaginary component X as the reactance. The geometry of the burner between the housing wall and the burner exit plane also plays a role in this context. Maintaining a combustion airflow through the perforated section while the combustion chamber is operating results in different conditions than if a gas flow of this type were not present. Without a gas flow, the resistance would be nonlinear on account of being dependent on the convection and dissipation of the acoustically generated swirl, and consequently it could only be adapted with very great difficulty. In the present case, however, the continuous flow of the combustion air through the perforation openings leads to a linear contribution to the resistance R, on account of the convection of the swirl caused by this through-flow. This linear effect outweighs the nonlinear effect if the through-flow velocity is greater than the acoustic velocity in the perforation holes. In this case, the resistance R is described by the following equation:

$$R=\rho*\zeta*U/\sigma \quad (1)$$

in which $\zeta$ is the pressure loss coefficient of the holes, U is the through-flow velocity of the combustion air and $\sigma$ is the degree of perforation of the perforations, i.e. the proportion of the total surface area of the wall which is formed by the surface area of the hole cross sections. Therefore, for an optimum damping condition ($R=\rho*c$), the value $$M=\sigma/\zeta \quad (2)$$

must apply, where $M=U/c$ is the Mach number of the through-flow of combustion air.

Furthermore, to comply with the reflection-free condition, it is necessary for the imaginary component of the acoustic impedance, known as the reactance X, to be approximately 0. The distance from the first through-flow element to the second through-flow element is used to set the reactance X with respect to the frequencies that are to be damped. The downstream element in this case serves as a fully reflecting wall (without damping) for the acoustic pressure oscillations. This is made possible by virtue of the fact that the pressure drop between the first through-flow element and the second through-flow element is divided up, with the result that the acoustic regions upstream and downstream of the through-flow elements are acoustically decoupled from one another. By selecting suitable values for the hole diameter, the hole length or wall thickness and the distance between the through-flow elements, it is possible to make the reactance X with respect to the frequency that is to be damped approximately 0.

The person skilled in the art who is familiar with the specialist field of acoustic oscillations and the equations on which this field is based will infer from this explanation unambiguous teaching as to how the through-flow elements are to be designed and adapted, and at what distance they are to be arranged in order to achieve optimum damping of the combustion pulsations which are to be expected in any case.

In a preferred embodiment of the invention, the through-flow elements comprise solid, non-porous components, into which passage openings, perforations, for the combustion air have been introduced in a manner which is known per se. Preference is given in particular to an embodiment in which the perforation is introduced into the through-flow elements by chip-forming machining, for example by drilling. By way of example, a sheet-metal blank of suitable thickness is brought into the desired shape by bending or pressing, and the through-flow openings are introduced into the blanks by a subsequent manufacturing process, in particular by drilling. It is also possible for a perforated metal sheet to be used from the outset. In another embodiment, a blank is brought into a suitable basic shape by a primary forming process, e.g. casting or sintering, and the perforation openings are then introduced. It is also possible for through-flow openings to be formed as early as during the primary forming operation. In any event, however, it is possible or necessary to fine-tune the through-flow opening by means of a further chip-forming machining operation, in order to achieve the required acoustic damping and/or reflection properties. However, it is very particularly preferred for the base material of the through-flow elements to be solid, i.e. for there to be no porosity in the base material. Although it is in principle also possible to use, for example, sintered porous base structures, such as metal felts, and despite the fact that this option is also fully encompassed within the scope of the invention, this embodiment is not deemed particularly advantageous, since it is very difficult to adapt the perforation openings to the desired properties described above.

The burner according to the invention may be of a geometric shape and structure which is known for known premix burners of the prior art. In this context, a type of burner in which the swirl body is composed of a plurality of part-shells in the shape of segments of a cone, between which lateral entry slots for the combustion air are formed, is preferred. A burner of this type is known, for example, from U.S. Pat. No. 4,932,861.

The burner according to the invention is suitable for use in firing devices and in particular for use in combustion chambers of gas-turbosets.

BRIEF DESCRIPTION OF THE DRAWINGS

The invention is explained again briefly below on the basis of an exemplary embodiment in conjunction with the drawings, in which.

DETAILED DESCRIPTION OF THE PREFERRED EMBODIMENTS

Figure 1A:
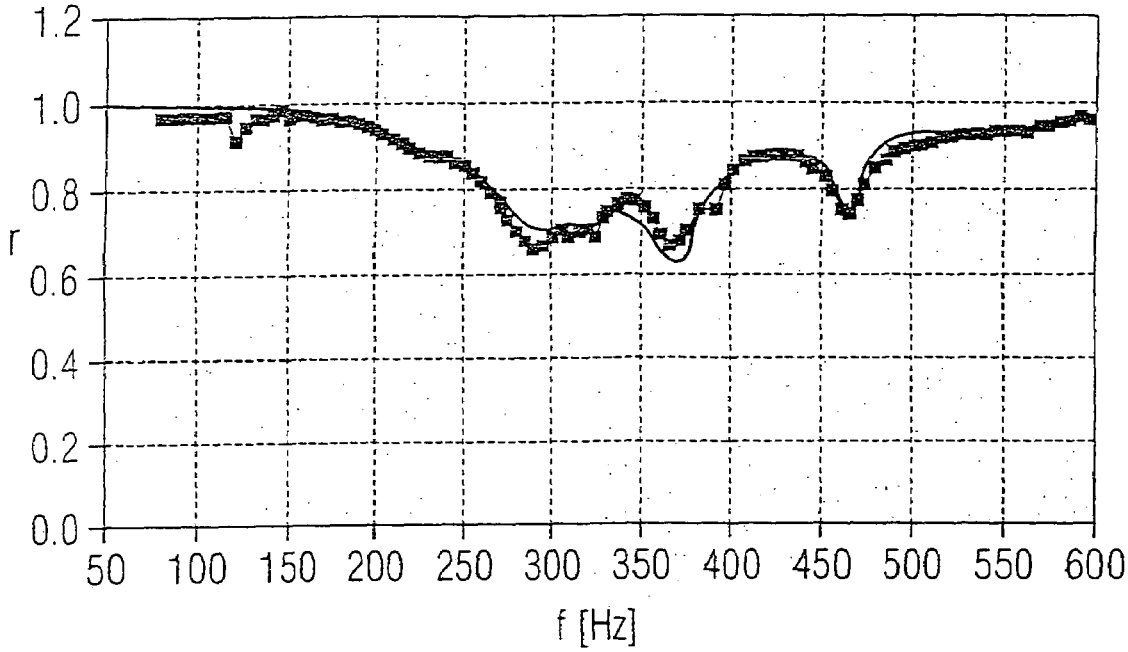
FIG. 1*a* shows an example of the value of the reflection coefficient r of a plate with a degree of perforation of 2.5% without a fixed through-flow through the individual perforation holes.

The text which follows explains examples of configurations of the present invention and the effects which are thereby achieved. In these figures, only the features which are of relevance to the invention are illustrated in the drawing. By way of example, the high-pressure and low-pressure turbines downstream of the combustion chamber, which are likewise present when the combustion chamber is used in a gas turbine installation, and the upstream compressor stage are not shown.

Figure 1B:
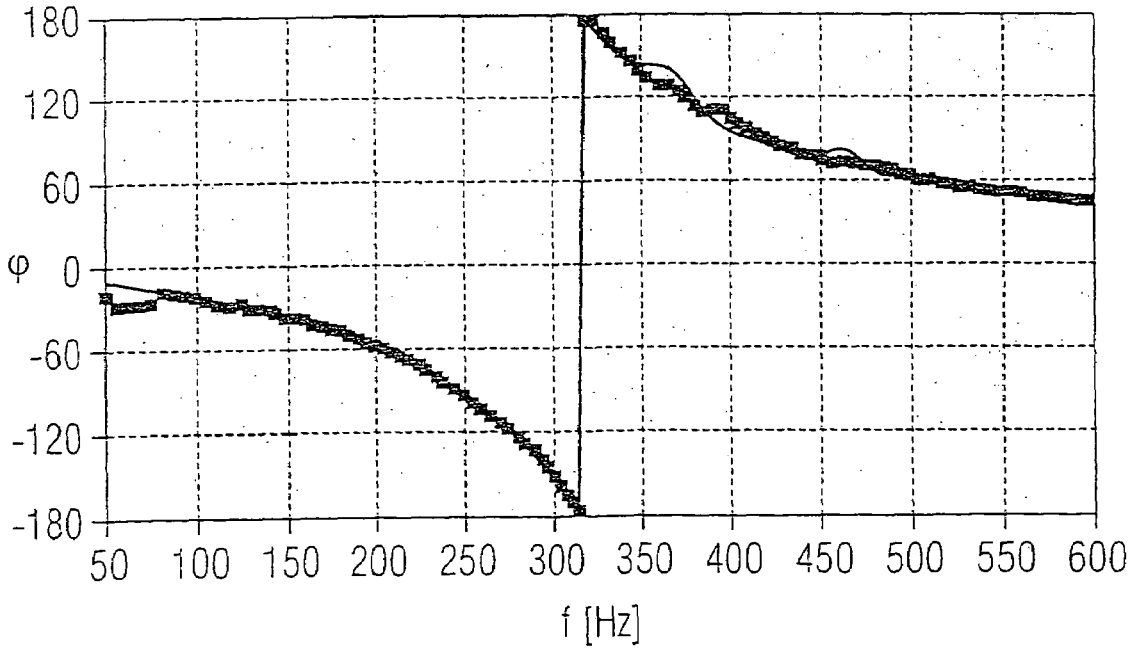
FIG. 1*b* shows the phase ϕ of the acoustic reflection coefficient of a plate as per FIG. 1*a;*
Figure 2A:
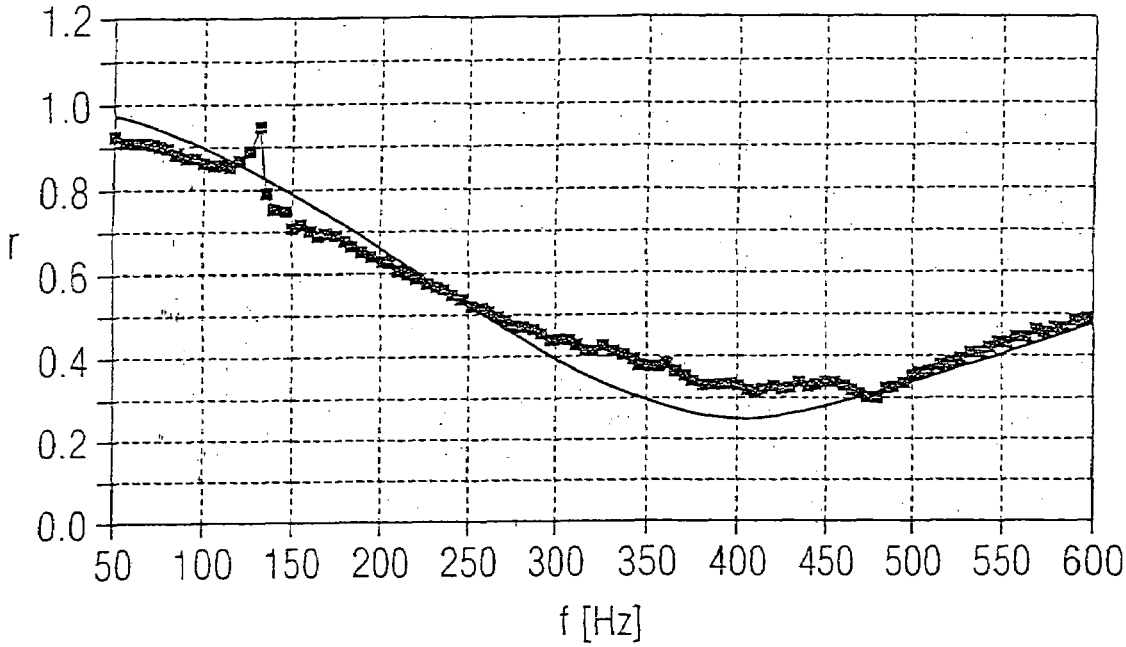
FIG. 2*a* shows the value of the acoustic reflection coefficient r for a plate with a degree of perforation of 2.5%, through which a constant through-flow of 8 m/s through the perforation holes is maintained.
Figure 2B:
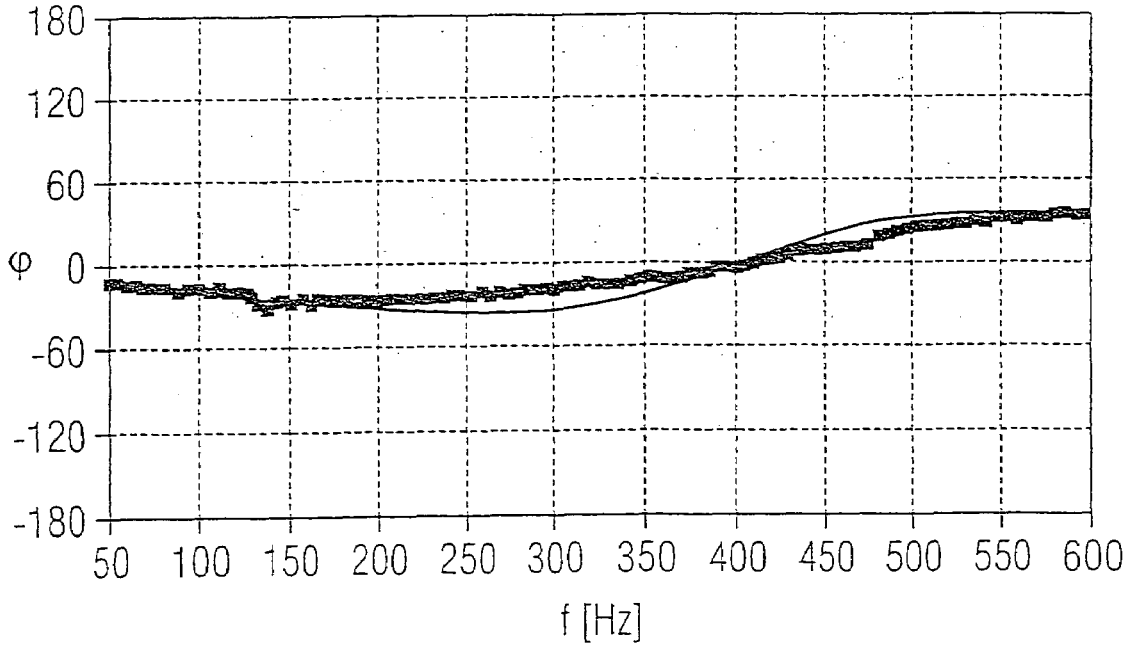
FIG. 2*b* shows the phase ϕ of the acoustic reflection coefficient for a plate as per FIG. 2*a;*

FIGS. 1 and 2 show a comparison of the effect of a perforated plate as used as perforated section of the present burner with and without a continuous through-flow of combustion air in accordance with the present invention. The solid lines in FIGS. 1 and 2 in this context show the values which have been calculated using a numerical model, and the rectangular boxes show measured values. The calculations and measurements were carried out using a perforated plate with a degree of perforation of 2.5%. The reflection coefficient r is calculated as $r=(Z+\rho^*c)/(Z-\rho^*c)$. In this context, the maximum absorption results for the resonant frequency, which in the illustration of the phase of the reflection coefficient is characterized by the sudden change in phase. The figures reveal the good correspondence between the calculated values and the measured values, which means that the model used is eminently suitable for the dimensioning of perforated sections of this type.

FIG. 2 shows the conditions which prevail in the present combustion chamber in which a continuous flow of combustion air is maintained through the perforated sections. This through-flow allows better setting of the resonant frequency of the damping and also leads to greater damping over a wider frequency range, as will be clearly apparent from a comparison of FIGS. 1*a* and 2*a*. Therefore, the present burner with the perforated sections in the housing wall, through which the combustion air is fed to the swirl generator, allows improved acoustic damping to be achieved.

Figure 3:
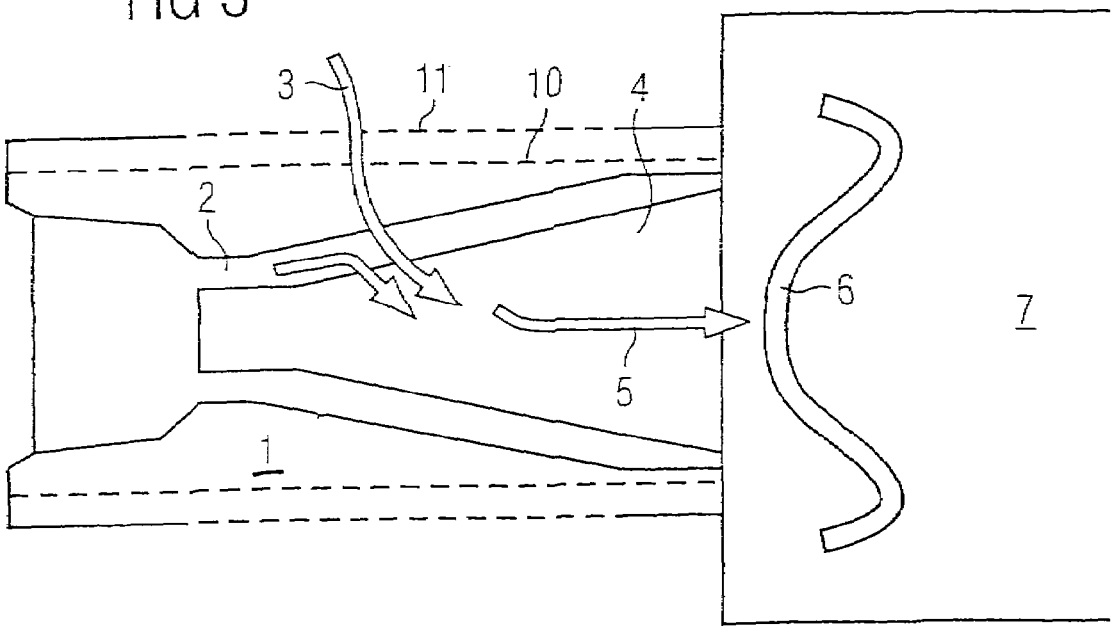
FIG. 3 shows a combustion chamber which comprises a burner according to the invention.

FIG. 3 shows a combustion chamber 7 having a burner 1 according to the invention. The burner 1 comprises a swirl generator 4, which has a conical interior for generating a swirling flow of the combustion air 3 which enters tangentially. As a result of this swirling flow, the fuel gas which is supplied via the feed 2 is mixed with the combustion air. In this way, a swirl-stabilized flame 6 with back-flow in the core is formed at the burner exit into the combustion chamber 7. The swirl generator 4 is arranged within two substantially coaxial hollow cylinders 10 and 11. The hollow cylinders 10 and 11 are perforated and constitute through-flow elements through which medium flows in series. The combustion air 3 which flows to the burner successively flows firstly through the second through-flow element 11 and then through the first through-flow element 10 before flowing into the swirl generator 4. In the interior of the swirl generator 4, a fuel supplied through the fuel feeds 2 is admixed to the combustion air. On account of the swirling flow in the swirl generator, a successfully premixed fuel/air mixture 5 is formed. The swirling flow breaks open at the exit into the combustion chamber 7, so as to form a flame front 6. Any combustion pulsations which occur in the combustion chamber 7 are avoided particularly efficiently if the reflection-free condition described above is satisfied for the respective pulsation frequencies in the plane of the burner exit to the combustion chamber 7, i.e. at the transition from the burner 1 to the combustion chamber. As has been explained above, this condition can be satisfied by suitably adapting the through-flow elements 11 and 10. In combination with the combustion air mass flow or the through-flow velocity of the combustion air, the distance between the through-flow elements, the degree of perforation of the first through-flow element 10, in the present example the inner through-flow element 10, and its thickness are adapted to one another in such a way that the conditions outlined above are satisfied. The first through-flow element 10, i.e. in the present case the inner hollow cylinder, is designed in such a way in terms of its perforation and its extent in the through-flow direction that in acoustic terms it has an at least approximately completely reflecting action. The second through-flow element, in the present case the outer hollow cylinder 11, is designed for maximum acoustic damping.

The burner according to the invention has a whole range of advantages. Firstly, the arrangement of the through-flow elements reduces the introduction of dirt particles. Furthermore, the incoming flow to the swirl generator is made more uniform. In addition, if the through-flow elements and the distance between them are suitably adapted, any combustion pulsations which do occur can be effectively damped or avoided.

It will be readily understood that the premix burner according to the invention can also be realized with swirl generator geometries other than those which are presented in the exemplary embodiment and are known, for example, from EP 0

321 809; in particular the invention can be implemented in conjunction with burners and/or swirl generators of the designs which are known from WO 93/17279, EP 0 945 677, WO 00/12936 or EP 0 780 629; this list should in no way be interpreted as exhaustive or restrictive.

| LIST OF DESIGNATIONS | |
|---|---|
| 1 | Burner |
| 2 | Feed for fuel gas |
| 3 | Combustion airstream |
| 4 | Swirl generator |
| 5 | Swirling flow |
| 6 | Flame |
| 7 | Combustion chamber |
| 10 | First, downstream through-flow element |
| 11 | Second, upstream through-flow element |
| r | Reflection coefficient |
| $\phi$ | Phase of the reflection coefficient |
| f | Frequency |

What is claimed is:

1. A premix burner for a gas turbine installation, comprising:

a swirl generator for a combustion airstream flowing to the burner, and first and second perforated through-flow elements;

wherein the swirl generator is arranged within the first perforated through-flow element;

wherein the first perforated through-flow element is arranged in an inflow region for the combustion airstream, and the second perforated through-flow element is arranged at a defined distance upstream of the first perforated through-flow element so that the combustion airstream flows in series through the second and the first perforated through-flow elements;

wherein distance between the first perforated through-flow element and the second perforated through-flow element, a degree of perforation of the first through-flow element, and an extent of the first through-flow element in a direction of through-flow are adapted to one another in such a manner that a complex acoustic impedance Z for characteristic pulsation frequencies of the burner at least approximately corresponds to a product of density of the combustion airstream and acoustic velocity in the combustion airstream.

2. The premix burner of claim 1, wherein the distance between the first perforated through-flow element and the second perforated through-flow element, the degree of perforation of the first perforated through-flow element, and the extent of the first perforated through-flow element in the direction of through-flow are adapted to one another in such a manner that an imaginary component of a complex acoustic impedance substantially becomes zero.

3. The premix burner of claim 1, wherein the through-flow elements are arranged in such a manner that substantially the entire combustion airstream has to flow through the through-flow elements.

4. The premix burner of claim 1, wherein the first perforated through-flow element is a hollow cylinder and the second perforated through-flow element is a hollow cylinder surrounding the first perforated through-flow element.

5. The premix burner of claim 4, wherein the swirl generator is arranged within the hollow cylinder of the first perforated through-flow element.

6. The premix burner of claim 1, wherein the swirl generator comprises a plurality of part-shells shaped as cone segments and has lateral entry slots for supplying the combustion airstream.

7. A premix burner for a gas turbine installation, comprising:

a swirl generator for a combustion airstream flowing to the burner;

a first perforated through-flow element arranged in an inflow region for the combustion airstream; and a second perforated through-flow element arranged upstream of the first perforated through-flow element so that the combustion airstream flows in series through the second and the first perforated through-flow elements;

wherein the swirl generator is arranged within the first perforated through-flow element; and wherein spacing between the first perforated through-flow element and the second perforated through-flow element, a degree of perforation of the first through-flow element, and an extent of the first through-flow element in a direction of through-flow are adapted to one another in such a manner that a complex acoustic impedance Z for characteristic pulsation frequencies of the burner at least approximately corresponds to a product of density of the combustion airstream and acoustic velocity in the combustion airstream.

8. The premix burner of claim 7, wherein the spacing between the first perforated through-flow element and the second perforated through-flow element, the degree of perforation of the first perforated through-flow element, and the extent of the first perforated through-flow element in a the direction of through-flow are adapted to one another in such a manner that an imaginary component of a complex acoustic impedance substantially becomes zero.

9. The premix burner of claim 7, wherein the through-flow elements are disposed so that substantially all of the combustion airstream has to flow through the through-flow elements.

10. The premix burner of claim 7, wherein each of the first and second perforated through-flow elements comprises a hollow cylinder, and wherein the second perforated through-flow element surrounds the first perforated through-flow element.

11. The premix burner of claim 10, wherein the swirl generator is arranged within the hollow cylinder of the first perforated through-flow element.

12. The premix burner of claim 7, wherein the swirl generator comprises:

a plurality of part-shells shaped as cone segments; and lateral entry slots for the combustion airstream.

13. A firing device comprising:

a combustion chamber; and at least one premix burner comprising a swirl generator for a combustion airstream flowing to the burner;

wherein a first perforated through-flow element is arranged in an inflow region for the combustion airstream, and a second perforated through-flow element is arranged at a defined distance upstream of the first perforated through-flow element;

wherein the swirl generator is arranged within the first perforated through-flow element;

wherein the first perforated through-flow element is arranged in an inflow region for the combustion airstream, and the second perforated through-flow element is arranged at a defined distance upstream of the first through-flow element so that the combustion airstream flows in series through the second and the first perforated through-flow elements;

wherein distance between the first perforated through-flow element and the second perforated through-flow element, a degree of perforation of the first through-flow element, and an extent of the first through-flow element in a direction of through-flow are adapted to one another in such a manner that a complex acoustic impedance Z for characteristic pulsation frequencies of the burner at least approximately corresponds to a product of density of the combustion airstream and acoustic velocity in the combustion airstream.

14. A gas turboset comprising at least one combustion chamber with at least one premix burner, the premix burner comprising a swirl generator for a combustion airstream flowing to the burner;

wherein a first perforated through-flow element is arranged in an inflow region for the combustion airstream, and a second perforated through-flow element is arranged at a defined distance upstream of the first perforated through-flow element;

wherein the swirl generator is arranged within the first perforated through-flow element;

wherein the first perforated through-flow element is arranged in an inflow region for the combustion airstream, and the second perforated through-flow element is arranged at a defined distance upstream of the first through-flow element so that the combustion airstream flows in series through the second and the first perforated through-flow elements;

wherein distance between the first perforated through-flow element and the second perforated through-flow element, a degree of perforation of the first through-flow element, and an extent of the first through-flow element in a direction of through-flow are adapted to one another in such a manner that a complex acoustic impedance Z for characteristic pulsation frequencies of the burner at least approximately corresponds to a product of density of the combustion airstream and acoustic velocity in the combustion airstream.

* * * * *

UNITED STATES PATENT AND TRADEMARK OFFICE

CERTIFICATE OF CORRECTION

PATENT NO. : 7,424,804 B2
APPLICATION NO. : 11/214919
DATED : September 16, 2008
INVENTOR(S) : Bellucci et al.

It is certified that error appears in the above-identified patent and that said Letters Patent is hereby corrected as shown below:

In claim 8, Col. 8, line 31, replace "in a the" with --in the--.

Signed and Sealed this

Second Day of December, 2008

JON W. DUDAS
*Director of the United States Patent and Trademark Office*